US007453414B2

(12) United States Patent
Parsche

(10) Patent No.: US 7,453,414 B2
(45) Date of Patent: Nov. 18, 2008

(54) BROADBAND OMNIDIRECTIONAL LOOP ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 429 days.

(21) Appl. No.: 11/330,642

(22) Filed: Jan. 12, 2006

(65) Prior Publication Data

US 2007/0159408 A1 Jul. 12, 2007

(51) Int. Cl.
*H01Q 21/00* (2006.01)

(52) U.S. Cl. ..... 343/866; 343/773; 343/867; 343/807

(58) Field of Classification Search ..... 343/773, 343/774, 866, 867, 741, 742, 807, 795
See application file for complete search history.

(56) References Cited

U.S. PATENT DOCUMENTS 3,605,099 A * 9/1971 Griffith ..... 343/771
4,143,377 A * 3/1979 Salvat et al. ..... 343/755
5,134,420 A * 7/1992 Rosen et al. ..... 343/756
6,154,182 A * 11/2000 McLean ..... 343/773
6,414,647 B1 7/2002 Lee ..... 343/793
2003/0107524 A1* 6/2003 Hart ..... 343/860
2006/0012535 A1* 1/2006 McLean ..... 343/742
2006/0238432 A1* 10/2006 Mikami et al. ..... 343/795

* cited by examiner

*Primary Examiner*—HoangAnh T Le
(74) *Attorney, Agent, or Firm*—Allen, Dyer, Doppelt, Milbrath & Gilchrist, P.A.

(57) ABSTRACT

The biconical loop antenna is the dual and compliment to the biconical dipole antenna, and has broadband omnidirectional horizontally polarized radiation. The antenna includes a conductive antenna body having first and second opposing ends with a medial portion therebetween. The antenna body has a slot extending from at least adjacent the first end to at least adjacent the second end, and the medial portion of the antenna body is wider than the opposing ends. First and second body portions may be conical antenna elements connected together at their respective bases. Antenna feed points are at the medial and chine portion of the antenna body adjacent the slot.

20 Claims, 8 Drawing Sheets

BROADBAND OMNIDIRECTIONAL LOOP ANTENNA AND ASSOCIATED METHODS

FIELD OF THE INVENTION

The present invention relates to the field of antennas, and more particularly, this invention relates to broadband omnidirectional antennas, loop antennas, conical antennas, horizontal polarization antennas, and related methods.

BACKGROUND OF THE INVENTION

An antenna is a transducer that converts radio frequency electric current to electromagnetic waves that are then radiated into space. The antenna may also convert electromagnetic waves into electric current. The electric field or "E" plane determines the polarization or orientation of the radio wave. In general, most antennas radiate either linear or circular polarization.

A linearly polarized antenna radiates in one plane. In a circularly polarized antenna, the plane of polarization rotates in a circle making one complete revolution during one period of the wave. An antenna is said to be vertically polarized (linear) when its electric field is perpendicular to the Earth's surface. An example of a vertical antenna is a broadcast tower for AM radio or the "whip" antenna on an automobile.

Horizontally polarized linear antennas, such as dipole turnstiles, wire loops and slotted cylinders, have their electric field parallel to the Earth's surface. Television transmissions in the United States typically use horizontal polarization.

Present day omnidirectional horizontally polarized antennas, such as turnstile dipoles, wire loops and slotted cylinders, have limited bandwidth. For example, U.S. Pat. No. 6,414,647 to Lee discloses a circularly polarized slot-dipole antenna, where the slot and the dipole are located in the same physical structure. The antenna includes two substantially cylindrical members with a slot located on the outer surface of the antenna.

Conical antennas, which include a single inverted cone over a ground plane, and biconical antennas, which include a pair of cones oriented with their apexes pointing toward each other, are used as broadband antennas for various applications, for example, spectrum surveillance. Conical antennas have previously been known as the wave transformer or omnidirectional horn antennas, and are noted for their great bandwidth.

Inventorship of the Biconical Dipole Antenna has been attributed to Sir Oliver Lodge in 1897. Wire cage conical monopole antennas were used by 1905, at the Marconi Transatlantic Stations. Later, a biconical dipole antenna including a coaxial feed structure, was disclosed in U.S. Pat. No. 2,175,252 to Carter entitled "Short Wave Antenna".

Excitation of biconical dipoles is accomplished by imparting an electrical potential across the apex of the two opposing cones, causing a TEM mode. This mode is analogous to the $TE_{01}$ mode of sectoral horns, but as the biconical dipole is a complete figure of revolution, symmetric about the cone axis, the TEM mode results. In a sectoral horn, a monopole probe is commonly used for excitation. In a biconical dipole, excitation is by the dipole moment formed across the horn walls (opposing cones), so the structure is self exciting. A biconical dipole antenna is an example of an omnidirectional vertically polarized antenna of relatively great bandwidth.

$TE_{10}$ modeling of conventional biconical dipole structures has been proposed for the purpose of horizontal polarization and omnidirectional radiation. In one instance, a circle of wire operates as loop antenna and excitation probe, and is placed normal to the bicone axis (Chu et. al., "Biconical Electromagnetic Horns", Proceedings of the IRE, Vol. 27, page 769, December 1939). In this approach, the cones act only as horn walls and they are not self exciting. Gain bandwidth of this system is limited, due to the narrow bandwidth of the wire loop probe.

Loop antennas relate to circles, and they can be open or closed, as in the hole of wire loop or the solid center of a metal disc antenna. Current can be conveyed in a circle, as around the rim of metal disc, the periphery of a hole in a metal sheet, or along a circular ring of wire. Solid planar loop antennas not having an open aperture, formed in or of a metal sheet, are slot antennas and operate according to Babinet's Principle. Slot antennas can be either loop or dipole, according to their shapes, as circles or lines.

Planar slot equivalent loops, such as the circular metal disc antenna, are less common than planar slot dipoles in the radio field, yet their use can be preferential. In one tradeoff, slot loops of one wavelength circumference operate at $2^{nd}$ harmonic or antiresonance, to provide a nominal 50 ohm driving resistance. A preferred method of excitation is to notch the metal sheet from which they are formed, such as to cause a discontinuity. Slot loops are therefore easily implemented.

Antennas then, can be divided into two canonical forms including the dipole antenna and the loop antenna, which correspond to the capacitor and inductor of RF electronics, having radial near fields that are electric or magnetic respectively. Thus, radiation may be caused by two distinct mechanisms including separation of charge in dipoles and conveyance of charge in loops. The dipole relates to the line while the loop relates to the circle. While broadband dipoles are known in the art, for example, the biconical and bowtie dipoles, the broadband forms of loop antennas have largely been unknown.

The conical and spatial, or 3-D volumetric form, of dipoles is well known, being the biconical dipole antenna. The conical and spatial form of loop antennas has however, remained unknown. Consequently, there still is a need for a broadband omnidirectional horizontally polarized antenna, and a dual to compliment the biconical dipole.

SUMMARY OF THE INVENTION

In view of the foregoing background, it is therefore an object of the present invention to provide an omnidirectional horizontally polarized loop antenna that operates over a wide band of frequencies, and a corresponding dual for the biconical dipole antenna, a biconical loop antenna.

This and other objects, features, and advantages in accordance with the present invention are provided by a broadband omnidirectional horizontally polarized loop antenna, a biconical loop antenna, including a conductive antenna body having first and second opposing ends with a medial portion therebetween. The antenna body has a slot extending from at least adjacent the first end to at least adjacent the second end, and the medial portion of the antenna body is wider than the opposing ends.

There may be antenna feed points at the medial portion of the antenna body adjacent the slot. Furthermore, the antenna body may include first and second body portions connected together at the medial portion of the antenna body. The first body portion or each of the first and second body portions may comprise a conical antenna element made from a continuous conductive layer or a wire structure. The antenna body may be hollow or a solid. In the solid antenna body, the slot also extends from a central axis of the antenna body to an exterior surface thereof. A dielectric material may be in the slot of the antenna body, and the slot defines a slot transmission line.

Other objects, features, and advantages in accordance with the present invention are provided by a method of making a omnidirectional horizontally polarized antenna including forming a conductive antenna body including first and second opposing ends with a medial portion therebetween, the medial portion of the antenna body being wider than the opposing ends, and forming a dielectric slot extending from at least adjacent the first end to at least adjacent the second end of the conductive antenna body.

Forming the conductive antenna body may include forming first and second conical antenna elements each having an apex and a base opposite the apex, the bases being connected together to define the medial portion of the antenna body. The dielectric slot is formed extending from the apex of the first conical antenna element to the apex of the second conical antenna element, and the method may include connecting an antenna feed at feed points adjacent the slot at the medial portion of the antenna body.

BRIEF DESCRIPTION OF THE DRAWINGS

FIG. 3(A) is the azimuth cut; FIG. 3(B) is the elevation cut.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
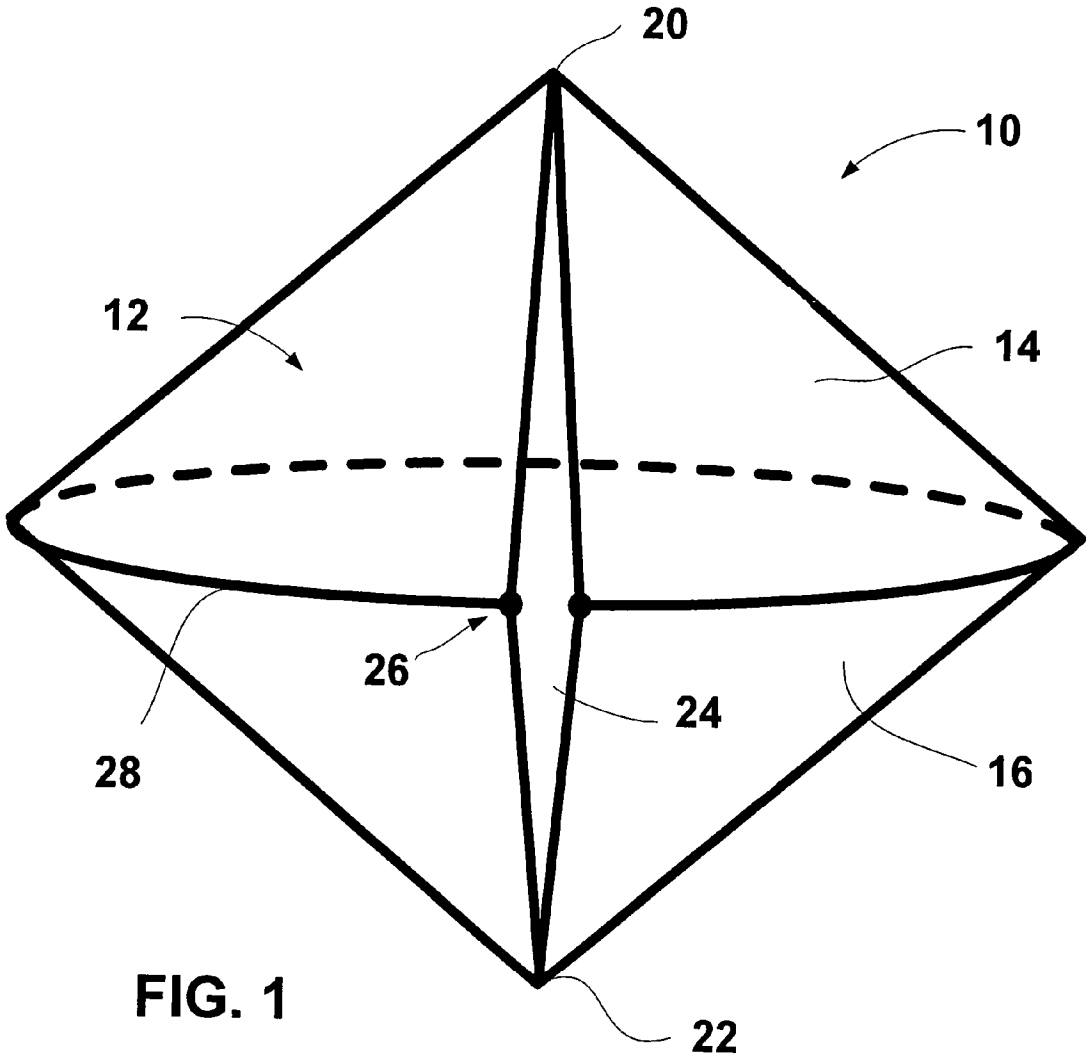
FIG. 1 is a side elevational view of a broadband omnidirectional horizontally polarized loop antenna, the biconical loop antenna, according to the present invention.

Referring initially to FIG. 1, a biconical loop antenna 10 in accordance with the present invention will be described. The biconical loop antenna 10 includes a conductive antenna body 12 with first and second body portions 14, 16 connected together at a medial portion 18 of the antenna body. First and second opposing ends 20, 22 have the medial portion 18 therebetween. The antenna body 12 has one or more slots 24 extending from at least adjacent the first end 20 to at least adjacent the second end 22. The medial portion 18 of the antenna body is wider than the opposing ends. The biconical loop antenna 10 has an omnidirectional pattern and is horizontally polarized. Furthermore, the antenna 10 operates over a wide band of frequencies, having a response similar to a high pass filter, when excited with a uniform distribution.

Illustratively, antenna feed points 26 are at the medial portion of the antenna body adjacent the slot 24. Various antenna feeds, such as coaxial feeds or stripline feeds, and an associated feed network, would be connected at the feed points 26 to make the antenna an active element as would be appreciated by those skilled in the art. Jumpers may optionally be included along slot 24, to modify harmonic resonances.

One or both of the first and second body portions 14, 16 may be conical antenna elements as depicted in FIG. 1. Such conical antenna elements each have an apex, at the first and second opposing ends 20, 22 and a base opposite the apex. The bases are connected together to define the medial portion, or chine 28, of the antenna body 12. The antenna body 12 may be hollow or a solid. In the solid antenna body, the slot 24 also extends from a central axis of the antenna body 12 to an exterior surface thereof.

The antenna body 12 may be made from a continuous conductive layer such as brass sheet metal, for example. Alternatively, the antenna body 12 may be a meshed wire or cage structure, such a lattice of metal wires. A dielectric material, such as air or any other suitable dielectric, may be in the slot 24 of the antenna body 12, and the slot defines a slotted transmission line (STL) along its extent.

Figure 3A:
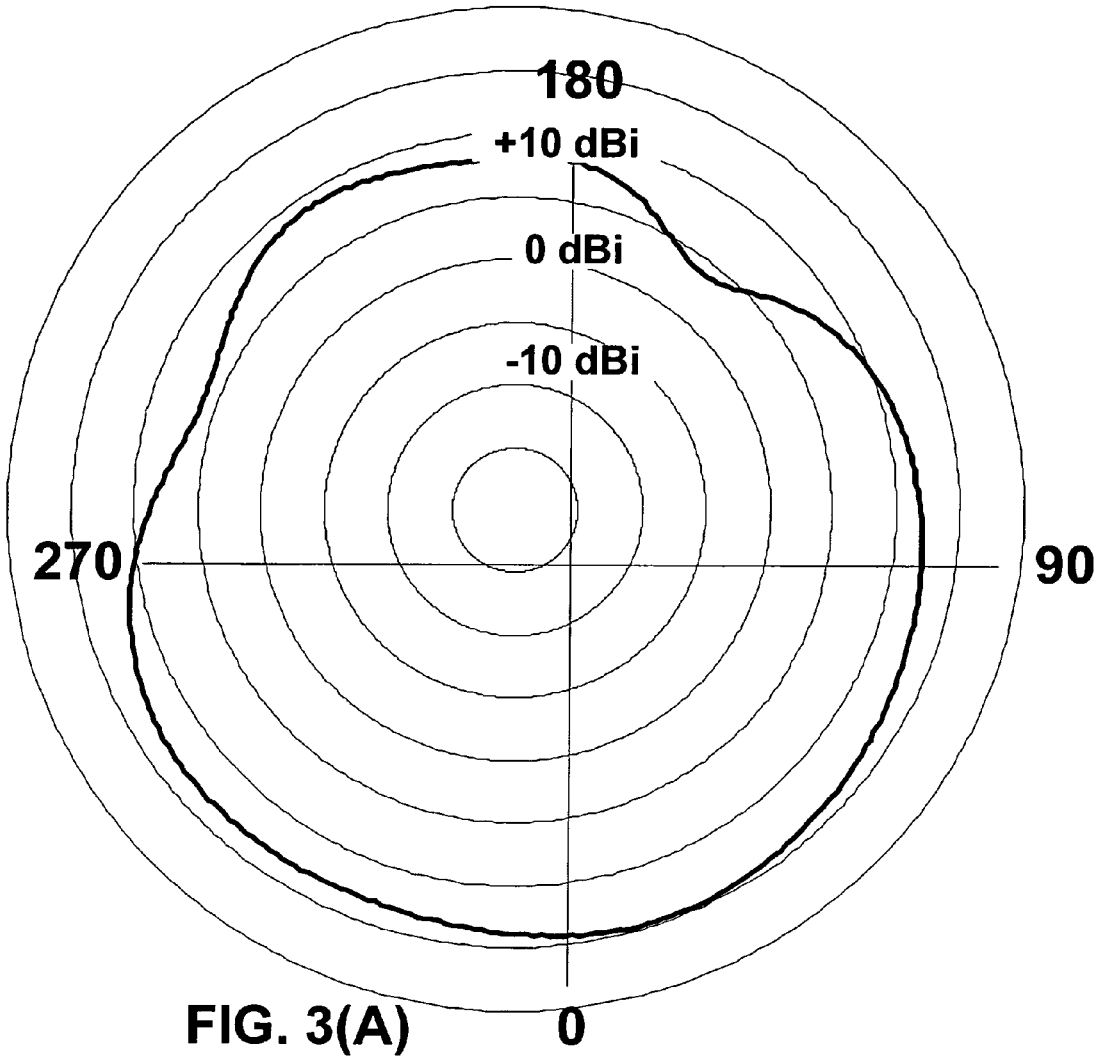
FIGS. 3A and 3B are the far field radiation patterns of an example of present invention antenna at fundamental resonance.
Figure 3B:
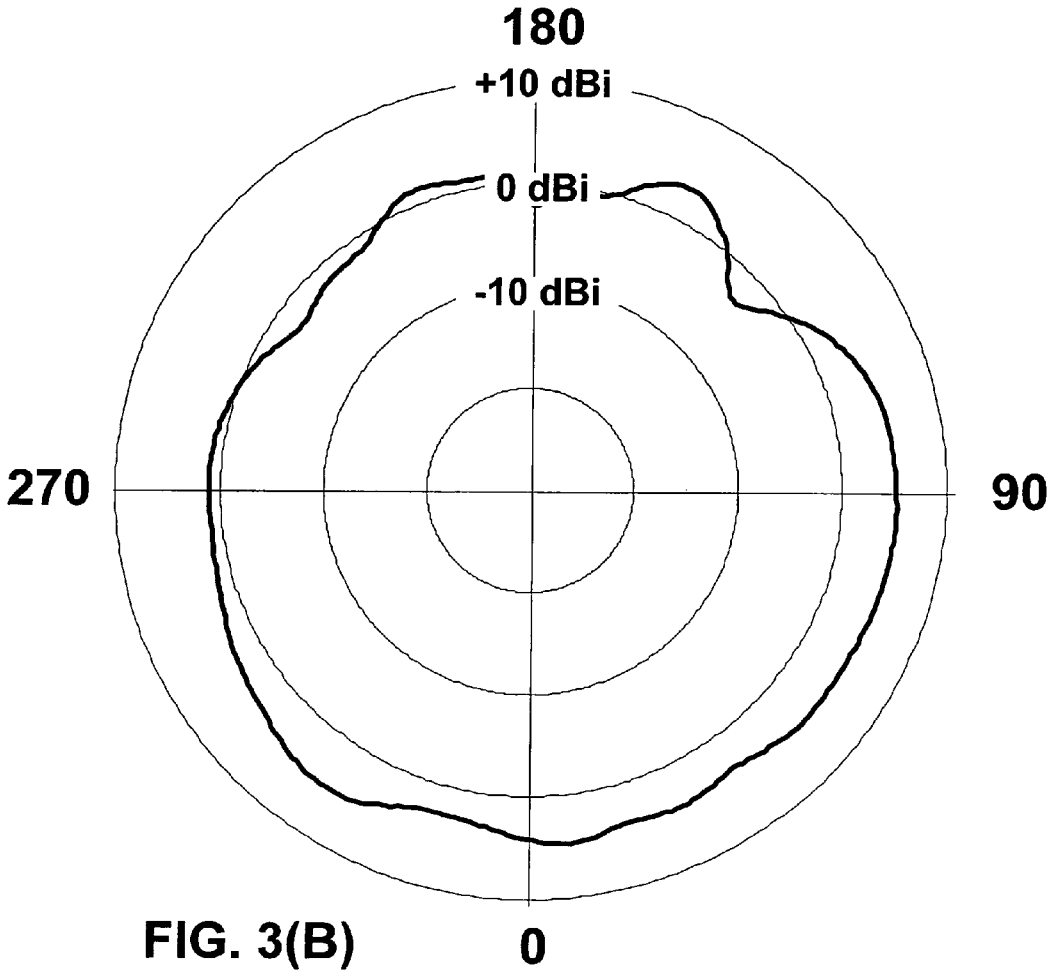

An example of the present invention biconical loop antenna 10, where the conical antenna elements 14, 16 are made from 0.006 inch rolled brass, has the base or mouth of the conical elements being about 8.25 inches wide and the height thereof being about 7.6 inches. Slot 24 is 1/16 inch across at the chine 28. Such an antenna may have radiation patterns as shown in FIGS. 3(A-B) at fundamental resonance at 547 Mhz. Specifically, FIG. 3(A) is the azimuthal, XY, or E plane radiation pattern, and FIG. 3(B) is an elevation, ZX, or H plane radiation pattern. A prototype and example of the present invention Biconical Loop Antenna 10 exhibited the parameter values listed in Table 1 below.

TABLE 1

EXAMPLE BICONICAL LOOP ANTENNA MEASURED DATA FROM PROTOTYPE

| Parameter | Value |
|---|---|
| Height | 7.6 Inches |
| Diameter | 8.25 Inches |
| Chine Circumference | 25.9 Inches |
| Flare Angle Of Cones | 97 Degrees |
| Driving Points | Intersection Of Chine and Slot Discontinuity |
| Fundamental Resonance Frequency | 547 Mhz |
| Chine Circumference At Fundamental Resonance | 1.20 Wavelengths |
| Driving Point Impedance, Fundamental Resonance | 404 + j0 Ohms |
| 2.0 to 1 VSWR Response, About Fundamental Resonance | 469 to 628 Mhz |
| 2.0 to 1 VSWR Bandwidth (In A 400 Ohm System) | 29 Percent |

Figure 4:
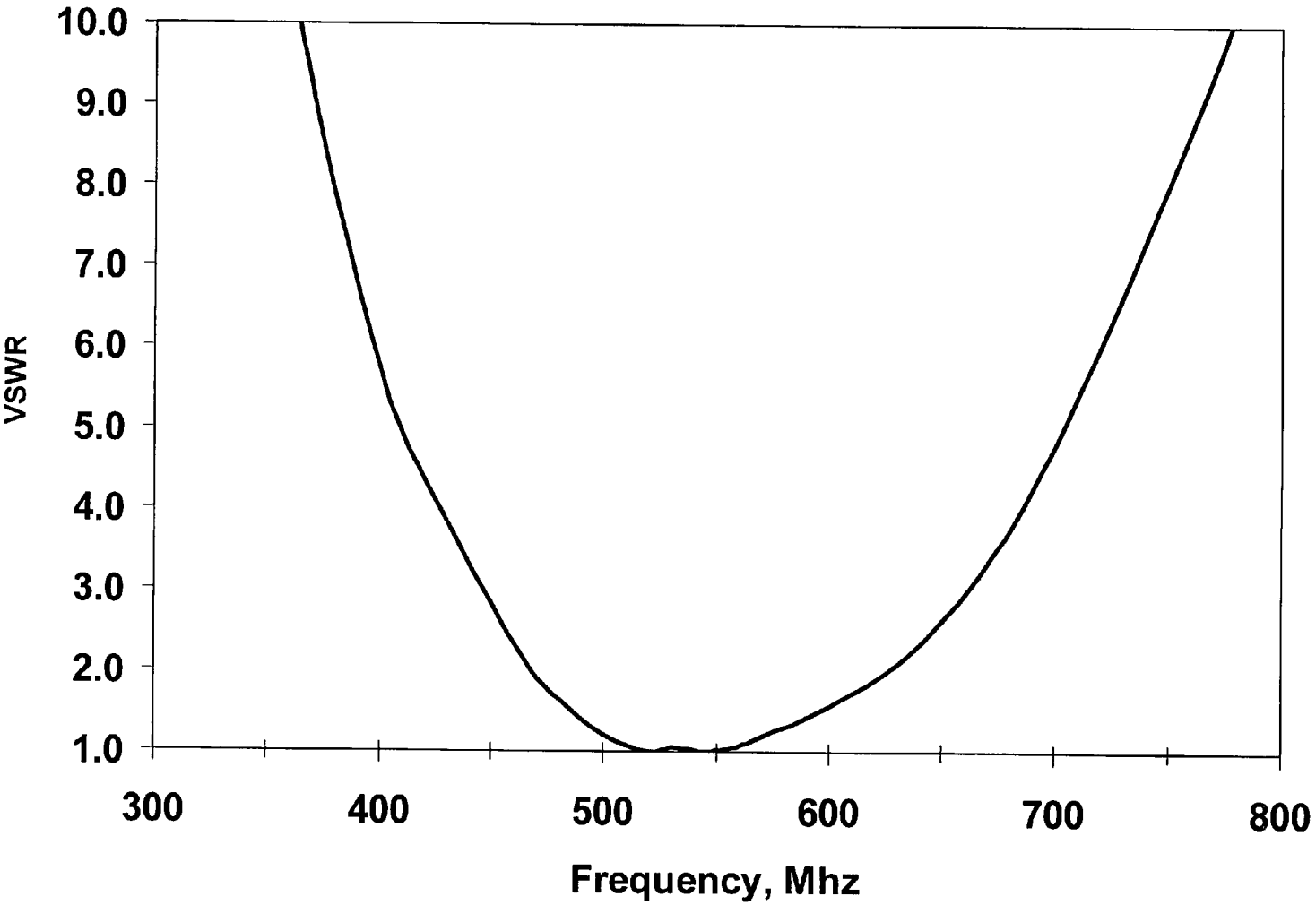
FIG. 4 is a graph illustrating the VSWR response of an example of the present invention antenna about fundamental resonance.
Figure 5:
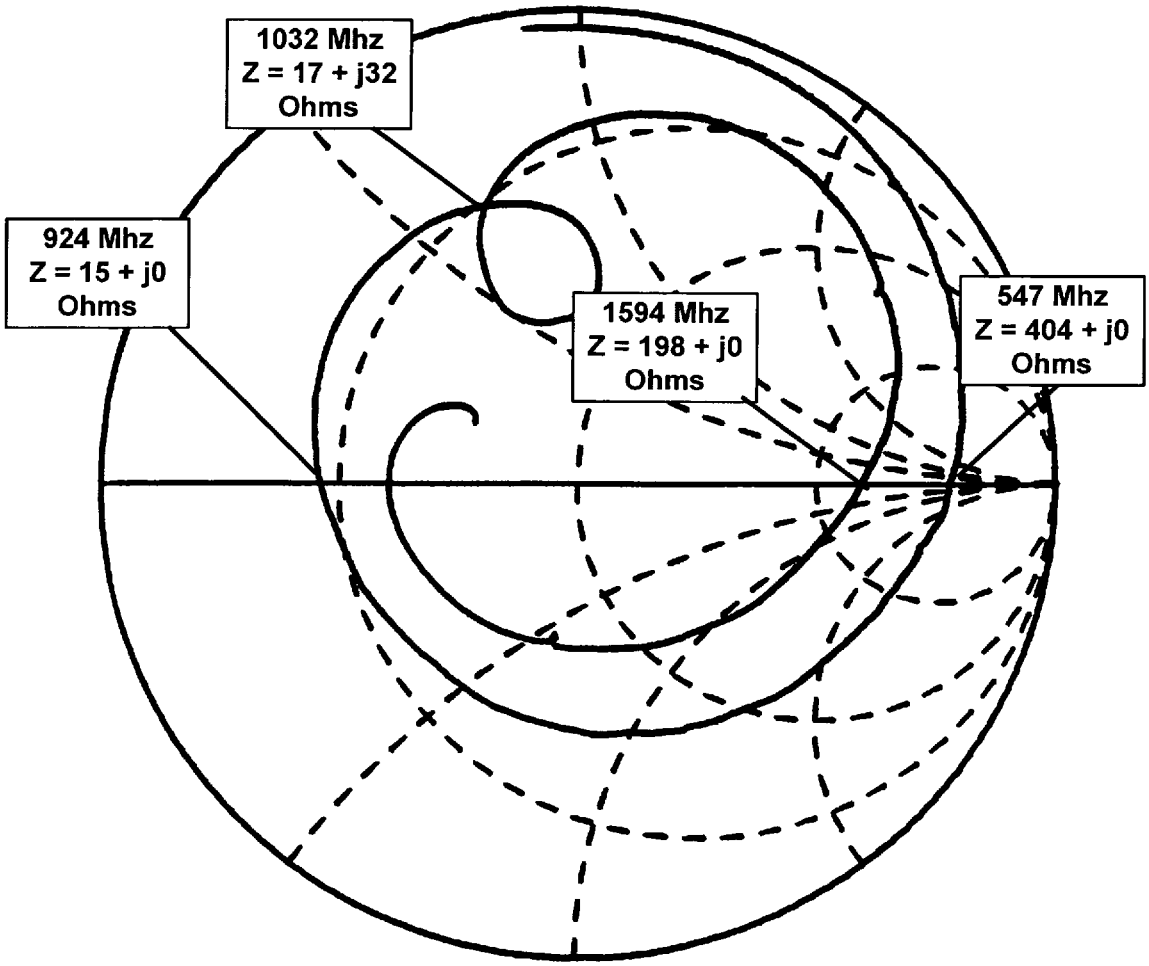
FIG. 5 is an un-normalized Smith Chart representation of the driving point impedance of the example of present invention antenna.

FIG. 4 depicts the measured VSWR response of the example of the present invention, about fundamental resonance and in free space, when the antenna was operated in a 400 ohm characteristic impedance system. FIG. 5 is a Smith Chart depiction of the un-normalized driving point impedance, measured on the example and prototype of the present invention.

The example of the present invention is representative in nature, and the invention may be tailored for various purposes, such as by varying height to diameter ratios, slot length, driving points, etc, as will be apparent to those skilled in the art. For instance, moving the driving points along slot 24 can adjust the resistance obtained at resonance.

Loop antennas and dipole antennas are related to each other by the constant pi (3.14), in that the resonant wire dipole is ½ wavelength long and the resonant wire loop is ½ wavelength in circumference, considering that the circumference of a circle is pi times its diameter. The present invention can be thought of as a loop antenna without a hole in the center. When antenna structures are of sufficient size, currents concentrate on edges, such as chine 28.

Antennas may be loop or dipole, corresponding to inductors or capacitors, which have radial near fields that are magnetic or electric. Antennas may also be objects, voids, or shell forms of the same; as known from Babinet's principle. Antennas may be implemented in one, two, or three dimensions of space, corresponding to linear, planar, and spatial forms.

The present invention is a biconcial loop antenna 10. It is the dual and compliment to the biconical dipole antenna, because currents are conveyed in circles rather than lines, circularly around the cones rather than linearly along the cones. Like the common biconical dipole, the biconical loop antenna 10 is a self exciting 360 degree horn antenna.

An inversion of the biconical dipole half elements (the cones) forms the biconical loop antenna 10. The "loop" is the circular rim, chine 28. Thus, two cones, mouths against each other, form a loop antenna, when current is conveyed circumferentially around them. The inversion of the cones is possible, as slot loop antennas do not have to "holes" in them. Cones therefore can form omnidirectional horn walls, when either opposed or joined at the mouth.

In one analysis, the present invention biconcial loop antenna 10 operates on the principle of surface waves. In the common art biconical dipole, cones form 360 degree horn walls and "guide" waves during expansion. The biconical loop antenna 10 does not enclose the expanding wave, but rather forms a refractive or guiding substrate. This effect may be familiar to those skilled in the art as surface wave or "ground wave" propagation, which propagates low frequency radio signals over the earth's horizon. The present invention is then a structure for the controlled expansion of surface waves, with the cones being a substrate rather than a wall.

Antennas can be either objects in space or holes in space, according to Babinet's Principle. The conventional biconical dipole antenna is an example of an object in space. Electromagnetic fields form inside the structure of the biconical dipole antenna and outside the structure of the present invention biconical loop antenna, such that the present invention appears to be a spatial slot type antenna. It can be said that it displaces fields, rather than containing them. The relationship between "panel" and slot compliment antenna driving point impedances is described by Bookers relation:

$$Z_s Z_c = \eta^2/4$$

Where:

$Z_s$=The Driving Point Impedance Of The Slot Antenna $Z_c$=The Driving Point Impedance of the Compliment (Panel) Antenna $\eta$=Wave Impedance Of Free Space=377 Ohms The driving point impedance of a thin wire loop, of 1 wavelength nominal circumference and finely adjusted for resonance, is about 72+j0 ohms. Applying this to Bookers relation, the driving point impedance of a 1 wavelength circumference slot loop is:

$$Z_s = (\eta^2/4)/Z_c = 493 + j0 \text{ Ohms}$$

As indicated in Table 1, the driving point impedance of the example and prototype of the present invention biconical loop antenna, was measured to be near 404+j0 ohms, at 1 wavelength nominal chine circumference.

The VSWR bandwidth of loop antennas is in general smaller than in dipole antennas. For instance, a biconical dipole, with wide cones, has a frequency response of the high pass filter type. They are said to assume characteristic impedance at great size, being akin to a transmission line. This effect was not observed in the biconical loop antenna. The impedance bandwidth of biconical loop antenna is broadband in the sense that it considerably exceeds the bandwidth of 2 dimensional loop antennas.

The gain of antennas is generally related to their electrical size. This is by directive effects, as beamwidth decreases as gain increases. Biconcical loop antenna 10 may be increased in size for increased gain.

Figure 6:
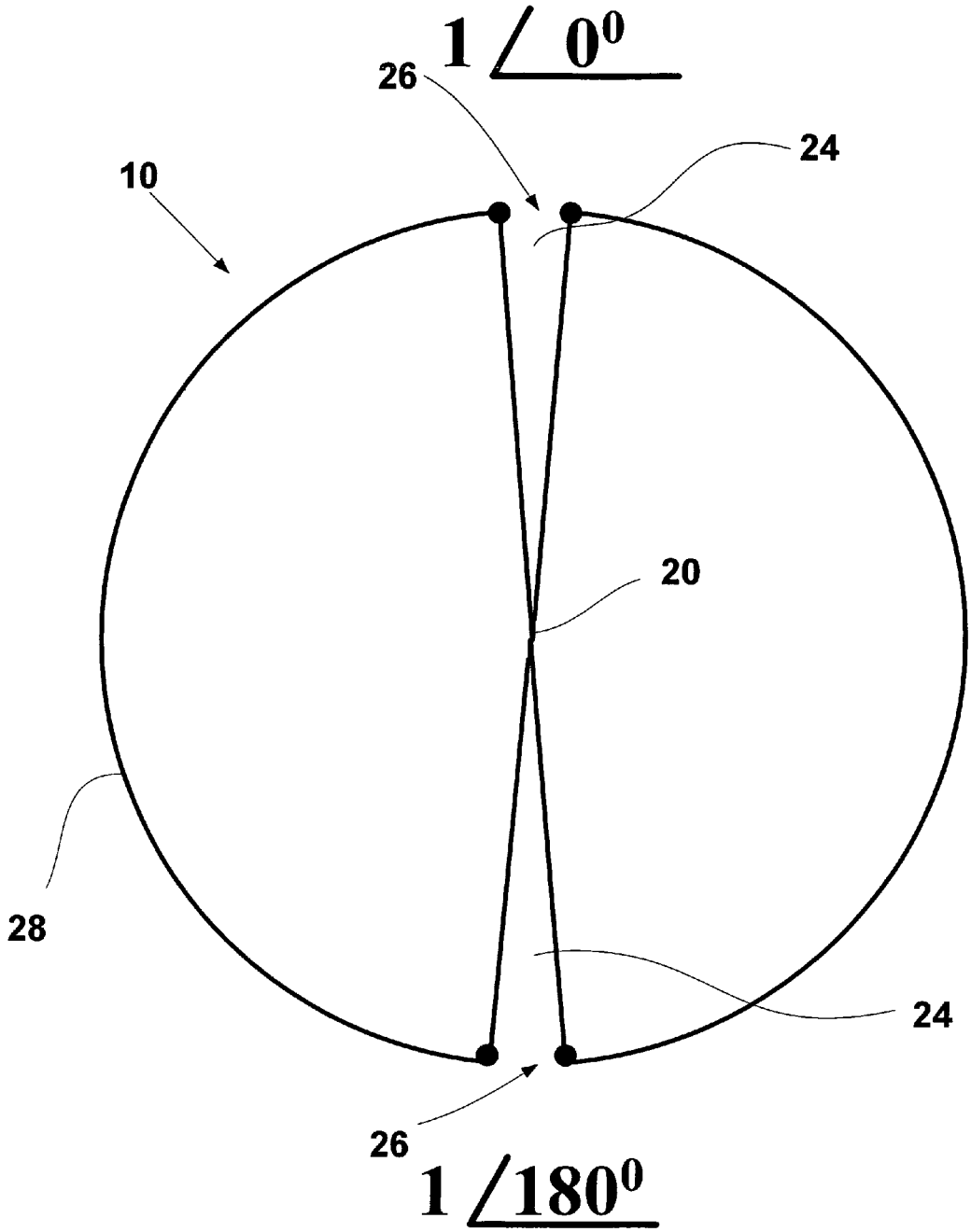
FIG. 6 is a plan view depicting phasing of the present invention antenna, when multiple driving slots are included.

Preferentially, the current distribution around the circumference of the present invention biconical loop antenna 10 is uniform in amplitude and phase. Antennas are, of course, sinusoidally excited in common usage and their radiating surfaces in turn assume current distributions that are sinusoidal. A uniform distribution may be approximated on the present invention by the use of multiple feed points/slots. FIG. 6 depicts in plan view the application of this principle, with two opposed driving points. This is similar to the method of Alford, in The Alford Loop ("Ultra-high Frequency Loop Antennas", A. Alford and A. G. Kandoian, Trans AIEE, 59, 843-848, 1940), and to multiple slotted cylinder antennas ("The Patterns Of Slotted Cylinder Antennas", George Sinclair, Proceedings of the IRE, December, 1948, pp 1487-1492). In loop antennas, E plane pattern ripple and circularity is related to the degree in which the uniform distribution is approximated. For higher frequencies, when antenna body 10 is electrically large, feed points/slots may be spaced every ½ wavelength around the chine.

Biconical loop antenna 10 may be excited by means other than slot 24, such as a gamma match along chine 28, as is common for dipoles, and the driven elements of yagi-uda antennas. Antenna body 10 is therefore not dependant upon slot 24 to radiate; other means of excitation may be used. Antenna body 12 may for instance operate as a parasitic element in an array. It is only necessary that a current flow around the circumference of body 12 to transduce electromagnetic fields. The biconical dipole can be thought to have a driving plane of discontinuity normal to the cone axis, and between the cone apexes. The biconical loop antenna can be thought to have a driving plane of discontinuity through the cone axis. Slot(s) 24 correspond to these planes of discontinuity. (If only one slot 24 is configured, the driving discontinuity is then a half plane).

Figure 7:
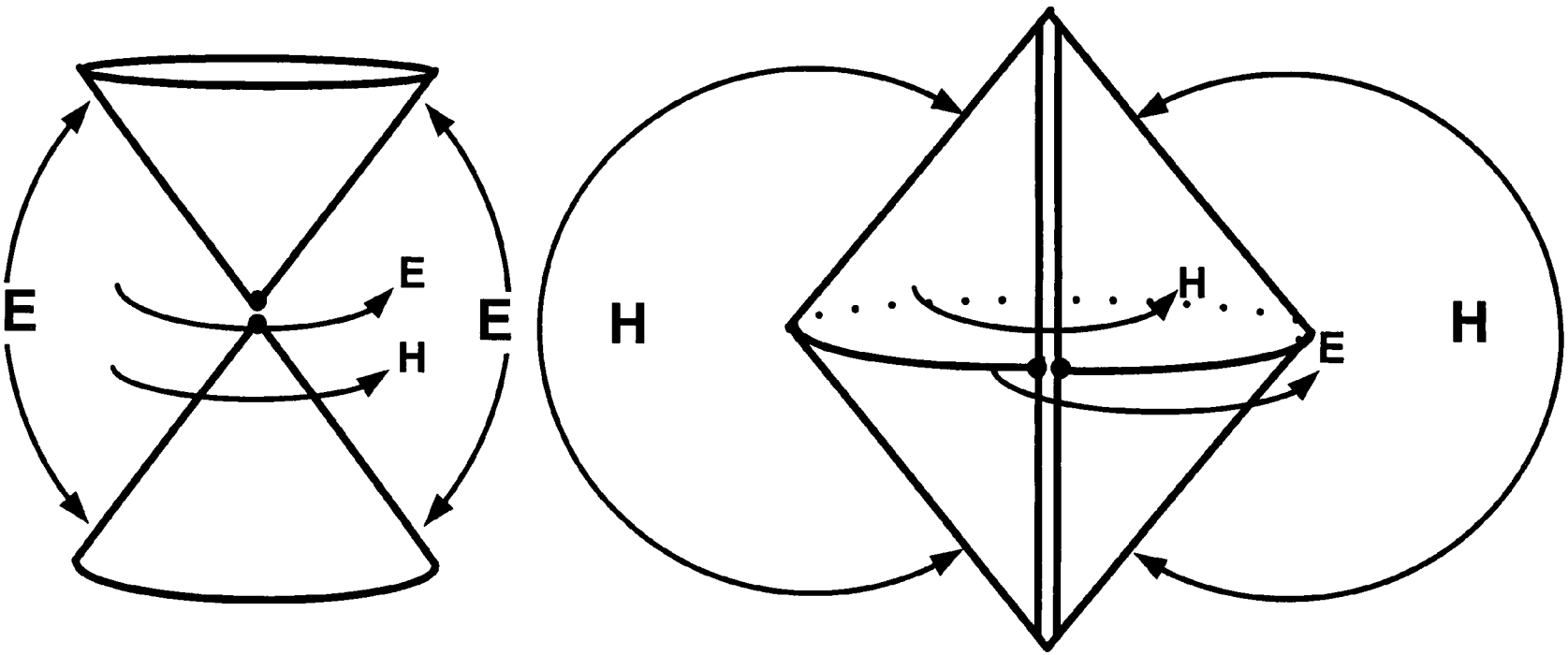
FIG. 7 is a diagram illustrating the reactive near fields of a conventional biconical dipole antenna, and the present invention biconical loop antenna of FIG. 1.

The reactive near fields of an electrically small conventional biconical dipole antenna and an electrically small biconical loop antenna 10 are illustrated in FIG. 7. The biconical dipole has radial reactive near fields that are electric only, while the biconical loop antenna 10 has radial reactive near fields that are magnetic only. Thus, the E and H fields from the two antennas are orthogonal. Both antennas have both E and H (electric and magnetic) circular near fields.

With respect to the antenna orientations of FIG. 7, the conventional biconical dipole antenna has vertical polarization in the far field, and the biconical loop antenna 10 has horizontal polarization in the far field. Wave polarization refers to the orientation of the E field component in the radiated wave or far field.

Figure 2:
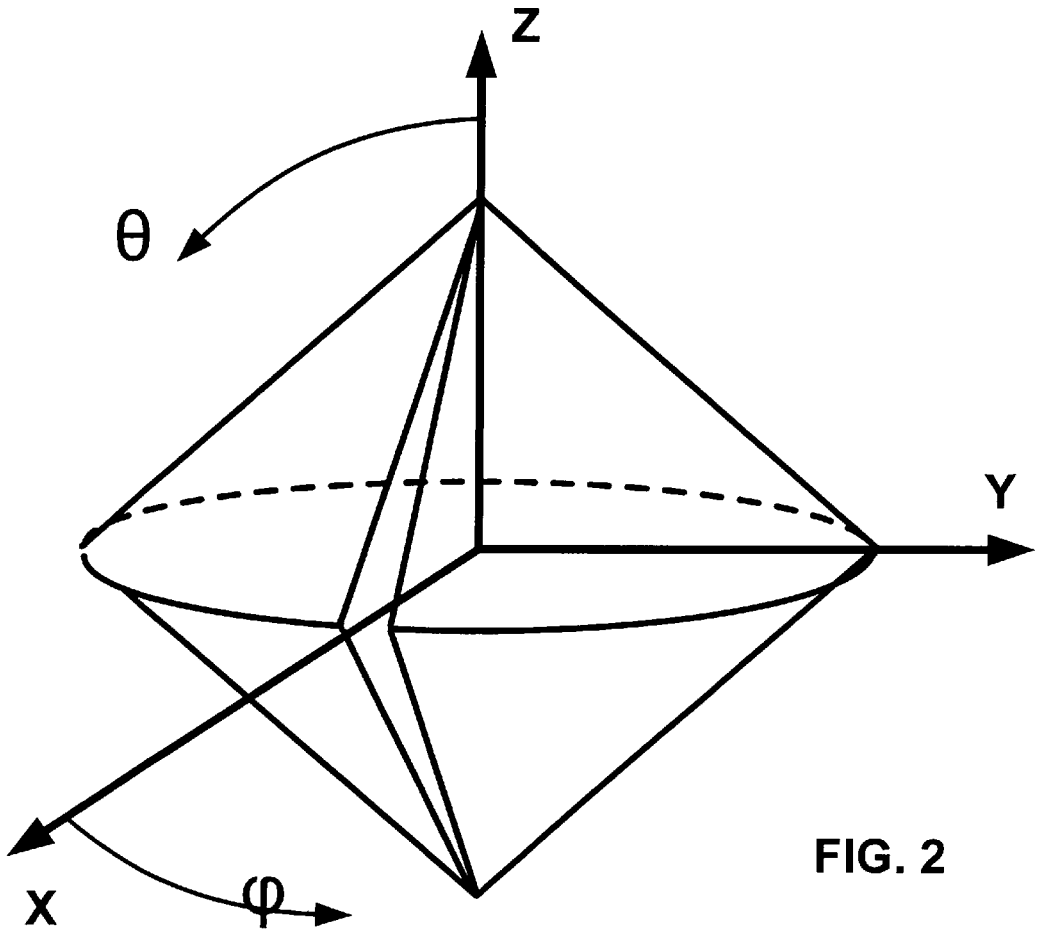
FIG. 2 is an isometric view of the present invention antenna of FIG. 1, in the radiation pattern coordinate system.

When electrically large with respect to wavelength, the present invention presents a low response to monostatic RADAR in the plane normal to the axis of rotation (XY plane of FIG. 2). By physical optics, maximum monostatic scattering cross section occurs normal to the conical surfaces. Thus, the present invention has properties of RADAR camouflage, which the biconical dipole does not. A biconical dipole with 90 degree cone angles is a retroreflector to the horizon.

A method aspect of the invention is directed to making a omnidirectional horizontally polarized biconical loop antenna 10 including forming a conductive antenna body 12 including first and second opposing ends 20, 22 with a medial portion 18 therebetween. The medial portion 18 of the antenna body 12 is wider than the opposing ends 20, 22. A dielectric slot 24 is formed extending from at least adjacent the first end 20 to at least adjacent the second end 22 of the conductive antenna body 12.

Forming the conductive antenna body 12 may include forming first and second conical antenna elements 14, 16 each having an apex and a base opposite the apex, the bases being connected together to define the medial portion 18 of the antenna body. The dielectric slot 24 is formed extending from the apex of the first conical antenna element 14 to the apex of the second conical antenna element 16, and the method may include connecting an antenna feed (not shown) at feed points 26 adjacent the slot 24 at the medial portion 18 of the antenna body 12.

As discussed above, conventional types of omnidirectional horizontally polarized antennas, such as turnstiled dipoles, wire loops and slotted cylinders all have limited bandwidth. The loop antenna of the present invention has an omnidirectional pattern, is horizontally polarized and broad in bandwidth above a lower cutoff frequency. Such an antenna is applicable to television broadcasting and reception and FM radio broadcasting. Home TV reception would be accomplished without pointing.

The apexes of the conical elements of a conventional biconical dipole antenna are adjacent each other, but in the loop antenna of the present invention, it is the mouths or bases of the conical elements that are adjacent each other. The slot or open seam along the conical elements creates an electrical discontinuity for excitation and functions as a slotted transmission line (STL).

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A broadband omnidirectional horizontally polarized loop antenna comprising:

a conductive antenna body including first and second opposing ends with a medial portion therebetween, the antenna body having a slot extending from at least adjacent the first end to at least adjacent the second end;

the medial portion of the antenna body being wider than the opposing ends; and antenna feed points at the medial portion of the antenna body adjacent the slot.

2. The antenna according to claim 1 wherein the antenna body comprises first and second body portions connected together at the medial portion of the antenna body.

3. The antenna according to claim 2 wherein the first body portion comprises a conical antenna element.

4. The antenna according to claim 2 wherein each of the first and second body portions comprises a conical antenna element.

5. The antenna according to claim 4 wherein each of the conical antenna elements comprises a continuous conductive layer.

6. The antenna according to claim 4 wherein each of the conical antenna elements comprises a wire structure.

7. The antenna according to claim 1 wherein the antenna body comprises a hollow antenna body.

8. The antenna according to claim 1 wherein the antenna body comprises a solid antenna body; and the slot also extends from a central axis of the antenna body to an exterior surface thereof.

9. The antenna according to claim 1 further comprising a dielectric material in the slot of the antenna body.

10. A omnidirectional horizontally polarized antenna comprising:

a conductive antenna body including first and second conical antenna elements each having an apex and a base opposite the apex, the bases being connected together to define a medial portion of the antenna body, and the antenna body having a dielectric slot extending from the apex of the first conical antenna element to the apex of the second conical antenna element; and antenna feed points at the medial portion of the antenna body adjacent the slot.

11. The antenna according to claim 10 wherein each of the conical antenna elements comprises a continuous conductive layer.

12. The antenna according to claim 10 wherein each of the conical antenna elements comprises a wire structure.

13. The antenna according to claim 10 wherein the antenna body comprises a hollow antenna body.

14. The antenna according to claim 10 wherein the antenna body comprises a solid antenna body; and the slot also extends from a central axis of the antenna body to an exterior surface thereof.

15. A method of making an omnidirectional horizontally polarized antenna comprising:

forming a conductive antenna body including first and second conical antenna elements each having an apex and a base opposite the apex, the bases being connected together to define a medial portion therebetween, the medial portion of the antenna body being wider than the opposing ends;

forming at least one dielectric slot extending from at least adjacent the apex of the first conical antenna element to the apex of the second conical antenna element; and connecting an antenna feed at feed points adjacent the at least one dielectric slot at the medial portion of the conductive antenna body.

16. The method according to claim 15 wherein forming the antenna body comprises forming each of the conical antenna elements as a continuous conductive layer.

17. The method according to claim 15 wherein forming the antenna body comprises forming each of the conical antenna elements as a wire structure.

18. The method according to claim 15 wherein forming the antenna body comprises forming the antenna body as a hollow antenna body.

19. The method according to claim 15 wherein forming the antenna body comprises forming the antenna body as a solid antenna body; and wherein forming the slot comprises forming the slot to extend from a central axis of the antenna body to an exterior surface thereof.

20. The method according to claim 15 wherein forming at least one slot comprises forming a plurality of slots in the antenna body.

* * * * *